United States Patent [19]

Flory

[11] Patent Number: 5,050,884

[45] Date of Patent: Sep. 24, 1991

[54] GOLF CLUB COMBINED WITH SHAFT PROTECTOR

[76] Inventor: Rex Flory, 6044 Ensign Ave., North Hollywood, Calif. 91606

[21] Appl. No.: 629,900

[22] Filed: Dec. 19, 1990

[51] Int. Cl.[5] ..... A63B 53/00; A63B 57/00

[52] U.S. Cl. ..... 273/162 R; 150/160; 206/315.2

[58] Field of Search ..... 206/315.2, 315.6, 446, 206/315.4; 150/160, 154; 273/162 R, DIG. 8; 138/32

[56] References Cited

U.S. PATENT DOCUMENTS

| | | | |
|---|---|---|---|
| 1,435,311 | 11/1922 | Knight | 206/446 |
| 2,947,307 | 8/1960 | Hoppe | 273/DIG. 8 X |
| 2,968,300 | 1/1961 | Allen | 150/154 X |
| 3,782,724 | 1/1974 | Rottman et al. | 273/DIG. 8 X |
| 3,965,955 | 6/1976 | Price | 150/160 |
| 4,662,415 | 5/1987 | Proutt | 273/162 R X |
| 4,898,222 | 2/1990 | Gaffney | 206/315.4 |

OTHER PUBLICATIONS

Sear Roebuck 1983 Spring Summer Catalog p. 1020 Relief On.

*Primary Examiner*—George J. Marlo
*Attorney, Agent, or Firm*—John J. Posta, Jr.

[57] ABSTRACT

The golf shaft guard includes a hollow foamed, spongy elastomeric tube with a generally central space extending the length thereof into which a non-metallic golf club shaft is inserted through a side slit running the length of the tube. The space preferably is dimensioned relative to the shaft so that the tube walls defining the space grip the shaft, holding the tube in place against the hosel of a golf club bearing the shaft. In one embodiment, the space is uniform in diameter, while the club shaft tapers down from its end grip to the hosel. In another embodiment, the tube and space are expanded to provide a head into which the head of the golf club is inserted for protection, the tube thus covering the head, hosel and shaft, the latter preferably throughout most of the length thereof. Thus, the invention includes the assembly of the golf club and guard. The guard protects non-metallic shafts from abrasion against other golf clubs, but particularly against the upper rim and space dividers of a golf bag in which the club-tube assembly is carried.

5 Claims, 1 Drawing Sheet

GOLF CLUB COMBINED WITH SHAFT PROTECTOR

FIELD OF THE INVENTION

The present invention generally relates to sports equipment and more particularly to a device which protects the non-metallic shafts of golf clubs.

PRIOR ART

Recent advances in golf club technology have provided golf clubs with non-metallic shafts which are generally lighter than metal and have improved shot-producing tensile characteristics. The older ones of these non-metallic shafts have been formed of plastic and plastic-fiberglass combinations. More recently, carbon fiber and carbon fiber-boron fiber composites have been formed into webs and used for producing high quality golf club shafts. Such shafts are relatively easily dented and easily abradable and must be protected. A common occurrence with non-metallic shaft-bearing golf clubs is excess wear of the shaft adjacent the club head hosel due to repeatedly striking the upper rim and/or dividers of a golf club bag in which a club bearing the shaft is carried. The club shaft can also be damaged by contacting the head of another golf club in the bag. Inasmuch as non-metallic shafts are expensive and their wear depreciates their strength and tensile properties, it is of prime importance to prevent such wear.

Accordingly, there is a need for means for effectively and inexpensively protecting non-metallic golf club shafts against all damage including abrasive wear while they are carried in a golf bag. Such means should be easily and rapidly used and be durable and attractive.

SUMMARY OF THE INVENTION

The improved golf shaft guard and guard-club assembly of the present invention satisfy all the foregoing needs. The guard is substantially as set forth in the Abstract of the Disclosure. Thus, the guard comprises a hollow foam spongy elastomeric tube with a generally central space extending the length thereof and with a side slit the length thereof extending from the tube exterior to the space. Preferably, the main length of the tube cavity is of uniform diameter and dimensioned to grip a non-metallic preferably tapered golf club shaft and hold in place around it adjacent the club head hosel so as to protect the upper portion of the shaft likely to be contacted by the upper rims and/or dividers of a golf club bag and by the heads of other golf clubs. The club shaft can be easily removed from and inserted into the tube cavity through the side slit.

In one embodiment, the head of the tube and cavity are expanded to receive the club head. Thus, in that instance, the tube entirely covers the club head and hosel and also covers most of the shaft. In such instance, the longitudinal side slit is preferably intersected by one or more cross slits in the head region to make insertion and removal of the club head easy relative to the tube. Since the tube is soft foamed rubber or plastic, it wears well and effectively cushions the golf club shaft from shock as well as dents and abrasion, such as commonly occur when the bag is dropped on the ground by a caddy, etc.

Various other features of the present invention are set forth in the following detailed description and accompanying drawings.

DRAWINGS

DETAILED DESCRIPTION

FIGS. 1-3

Figure 1:
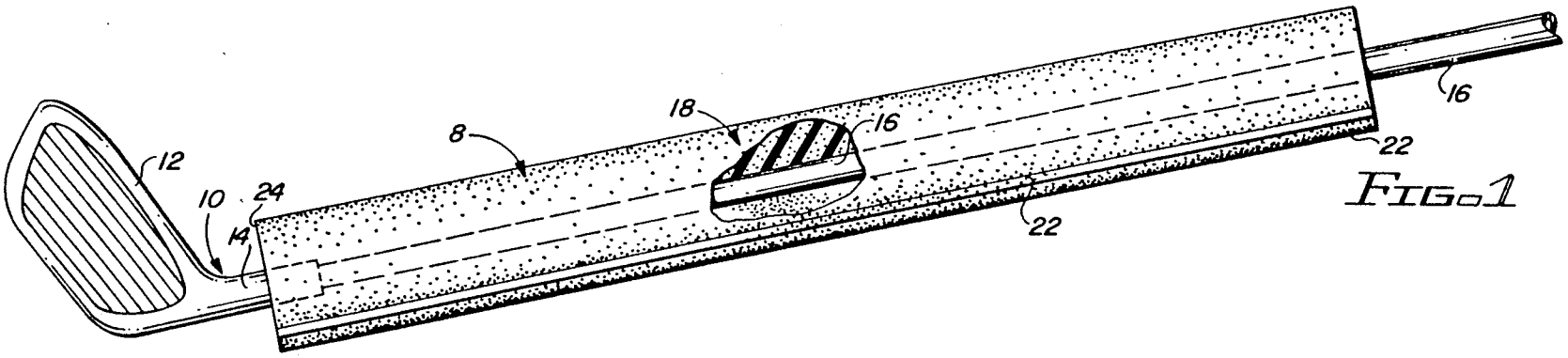
FIG. 1 is a schematic, fragmentary side elevation, partly broken away, of a golf club with a first preferred embodiment of the improved golf club shaft guard installed around the shaft thereof, the club and guard comprising a first preferred embodiment of the improved assembly of the present invention.
Figure 3:
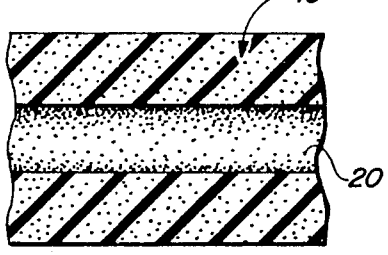
FIG. 3 is an enlarged, fragmentary schematic vertical cross-section of the tube of FIG. 1.
Figure 2:
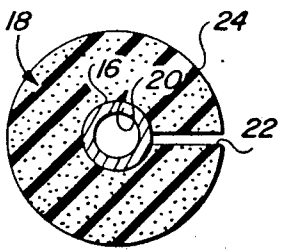
FIG. 2 is an enlarged schematic front end view, partly in section, of the assembly of FIG. 1.

Now referring more particularly to FIGS. 1-3 of the drawings, a first preferred embodiment of the improved golf club shaft guard of the present invention is schematically depicted therein, together with a golf club forming therewith a first preferred embodiment of the improved assembly of the present invention.

Thus, assembly 8 is shown which includes golf club 10, which comprises a head 12 of metal, wood or another material such as carbon, or a carbon-boron composite or the like, a hosel 14 of the same material and a non-metallic shaft 16 of plastic, carbon fiber or a carbon-fiber-boron fiber composite or the like. As such, shaft 16, although having superior tensile strength, is thin and light and is easily subject to damage by denting, scratching and other abrasion, particularly by the heads of other golf clubs and the to rim and dividers of a conventional golf bag in which club 10 may be carried. Shaft 16 increases in diameter from its front hosel end to the opposite rear hand grip end thereof (not shown).

Assembly 8 also includes an elongated, soft, resilient, flexible sponge rubber or plastic (elastomeric) tube 18 which has a central cavity or space 20 therein of uniform diameter extending the length thereof, with access thereto through slit 22 extending the length of tube 18 and from the outer surface 24 thereof to space 20.

Slit 22 can be easily opened in order to slip shaft 16 into space 20. Shaft 16 and space 20 are dimensioned preferably so that shaft 16 wedges in space 20, space 20 being of uniform diameter and shaft 16's diameter increasing toward the butt end thereof. Thus, the front end 24 of tube 20 is held next to or over hosel 14. Tube 18 is long enough to extend well below the upper rim of a golf bag when club 10 and assembly 8 are upright in such bag, thus preventing contact between the bag rim and dividers on the one hand and shaft 16 on the other hand.

Tube 18 also cushions club 10 against bumps and jars as the golf bag is placed on the ground, picked up, carried, etc. Accordingly, club 10 and shaft 16 thereof are well protected. Abrasion, nicking, denting and other damaging of shaft 16 are avoided. The thickness of tube 18 also helps hold club 10 apart from other clubs in the golf bag, tending to protect head 12 and hosel 14 as well. Accordingly, assembly 8 has improved properties.

FIG. 4

Figure 4:
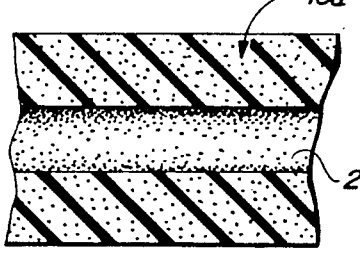
FIG. 4 is an enlarged, fragmentary schematic vertical cross-section of a modified version of the tube of the present invention; and, FIG. 5 is a schematic, fragmentary side elevation, partly broken away, of a second preferred embodiment of the improved golf club and shaft-guard assembly of the present invention.

A modified version of the improved tube of the present invention is schematically depicted in FIG. 4. Thus, tube 18 is shown which is identical to tube 18 except that space 20*a* is tapered rearwardly instead of being of uniform diameter throughout. Tube 18*a* can be substituted for tube 18.

FIG. 5

Figure 5:
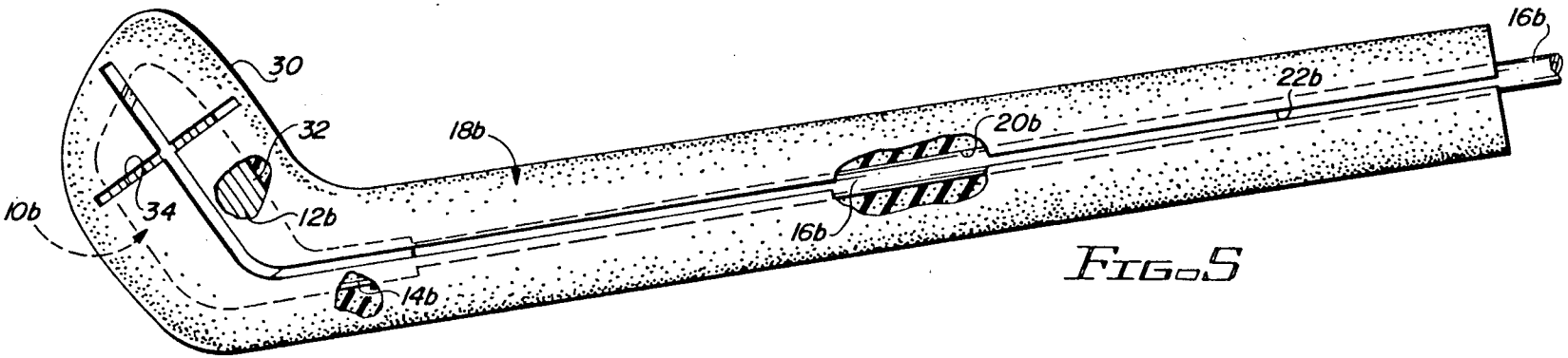

A second preferred embodiment of the improved assembly of the present invention is schematically depicted in FIG. 5. Thus, assembly 8*b* is shown. Components thereof similar to those of assembly 8 bear the same numerals but are succeeded by the letter "b". Assembly 8*b* differs from assembly 8 only as follows:

a) tube 18*b* has an expanded front head 30 and front portion 32 of internal space 20*b* to accommodate expanded head 12*b* of golf club 10*b*, club 10*b* also including hosel 14*b* and shaft 16*b* disposable within tube 18*b*;

b) slit 22*b* extends the length of tube 18*b* and is intersected by a cross slit 34 in head 30 to facilitate inserting head 12*b* in space portion 32 and removing it therefrom, while inserting shaft 16*b* into and removing it from space 20*b*.

Thus, tube 18*b* protects head 12*b* as well as hosel 14*b* and shaft 16*b* from damage. Moreover, it assures that tube 18*b* remains in a correct position over shaft 16*b*. Accordingly, space 20*b* need not form fit or grip shaft 16*b* but can be loose relative to shaft 16*b*, if desired. Assembly 8*b* offers full protection for club 10*b*.

Various other modifications, changes, alterations and additions can be made in the improved tube guard and assembly of the present invention, their components and parameters. All such modifications, changes, alterations and additions as are within the scope of the appended claims form part of the present invention.

What is claimed is:

1. An improved golf club assembly, said assembly comprising, in combination:

a) a golf club with a head, hosel and non-metallic shaft, the latter with a golf grip; and, b) a golf shaft guard comprising flexible, resilient, spongy material releasably disposed around said shaft, abutting said hosel and extending along the length of said shaft towards said grip, said guard comprising an elongated hollow tube having a generally central tubular space extending the length thereof and holding shaft therein to protect it from wear, said tube having a slit the length thereof, extending from the outer surface thereof to said central space for insertion of said shaft in said central space.

2. The improved assembly of claim 1 wherein said guard comprises foamed elastomer.

3. The improved assembly of claim 2 wherein said central space is of uniform diameter throughout the length thereof and said shaft tapers down from said grip to said hosel, said central space being smaller in diameter than the diameter of a portion of said shaft, whereby said tube grips said shaft and remains in a desired protective position adjacent said hosel.

4. The improved assembly of claim 1 wherein said tube has an expanded head with the central space thereof expanded and receiving said head and hosel of said club.

5. The improved assembly of claim 4 wherein said tube head has at least one cross slit intersecting said longitudinal slit to facilitate insertion of said club head therethrough.

* * * * *